United States Patent [19]

Tschudy

[11] Patent Number: 4,748,714

[45] Date of Patent: Jun. 7, 1988

[54] CLEANER WITH BELT SHIFTING

[75] Inventor: Donald B. Tschudy, Canton, Ohio

[73] Assignee: The Hoover Company, North Canton, Ohio

[21] Appl. No.: 927,653

[22] Filed: Nov. 6, 1986

[51] Int. Cl.[4] ..... A47L 5/26

[52] U.S. Cl. ..... 15/390; 15/332; 74/481; 474/122

[58] Field of Search ..... 15/332, 333, 390, 391; 74/481; 474/113, 119, 121, 122

[56] References Cited

U.S. PATENT DOCUMENTS

| | | | |
|---|---|---|---|
| 2,250,282 | 7/1941 | Swann | 15/390 |
| 2,616,119 | 11/1952 | Balluff | 15/390 |
| 2,637,874 | 5/1953 | White | 15/332 |
| 2,714,220 | 8/1955 | Cuddeback | 15/332 |
| 2,740,982 | 4/1956 | Brace | 15/332 |
| 4,446,594 | 5/1984 | Watanabe et al. | 474/122 |

FOREIGN PATENT DOCUMENTS

| | | | |
|---|---|---|---|
| 155204 | 3/1952 | Australia | 15/332 |

*Primary Examiner*—Robert W. Jenkins
*Assistant Examiner*—C. Reinckens
*Attorney, Agent, or Firm*—G. H. Kreske; R. B. Farley

[57] ABSTRACT

The invention comprehends a belt shifting arrangement for an upright cleaner in which belt shifting to an intermediate idler pulley is occasioned by either handle movement or pedal actuation. Either of these movements functions to cam the belt onto the idler pulley or to permit its movement back to an agitator drive pulley.

11 Claims, 4 Drawing Sheets

CLEANER WITH BELT SHIFTING

BACKGROUND OF THE INVENTION

1. Field of the Invention

This invention relates to floor care appliances and, more specifically, relates to an upright cleaner with a belt shifting arrangement.

2. Summary of the Prior Art

Cleaners of the upright type have been provided with agitator drive release by the use of belt shifting to an intermediate idler pulley so as to place the agitator in an inactive condition. Cleaners having such belt shifting for agitator release have included handle actuated releases and manually actuated lever releases. But, heretofore, no cleaner is known to have included combined handle and manually actuated lever belt shifting releases. This configuration would obviously provide a degree of flexibility unknown and not forecast by the prior art.

Accordingly, it is an object of the instant invention to provide an upright cleaner structure that has both handle and manually actuated lever belt release.

It is a further object of the invention to provide a handle and manually actuated lever belt release structure in which the handle and/or manual release may alternately be utilized for belt release.

It is a still further object of the invention to provide a handle and manually actuated lever belt release structure that is interrelated so as to actuate the same belt shifting mechanism.

It is an even further object of the invention to provide camming means with the handle and manually actuated lever release structures that engage and initiate movement of a belt shifting mechanism.

Other and additional objects of the invention will occur to the reader as the description of it proceeds.

SUMMARY OF THE INVENTION

The invention contemplates the use of an upright cleaner with an intermediate drive pulley. A belt extends from the motor to the intermediate drive pulley, in turn, drives a second pulley it common to it from which the agitator driving belt is trained. An idler pulley is disposed at the intermediate pulley location so that the drive belt extending from the motor may be shifted to it to disengage drive to the agitator. A pivoting, forked shift rod engages the motor belt to move it to the idler pulley. This shift rod is cammingly pivoted by a cam extending downwardly from the handle configuration which engages the shaft rod when the handle is moved to its upper position. The cam rod is also capable of being engaged by a cam mounted with a manually (pedal) actuated lever mounted pivotally on the cleaner and disposed at the rear of its hood. A push-push mechanism holds the pedal operated cam in its position of adjustment even though the pedal is spring urged to its rearward position after actuation. Thus, a second movement of the pedal must be operator initiated to move the pedal operated cam to an inactive position.

The shift rod pivots generally on a slightly angulated vertical axis and includes a rearwardly extending leg engageable by either the handle or pedal operated cam, with these cams urging this leg in a horizontal pivoting motion. The shift rod also has a forwardly extending leg that includes the forked portion which is downwardly open to provide a "bight" over the belt. Horizontal pivoting movement of the rearwardly extending leg of the shift rod causes a concommital movement of the forwardly extending leg to shift the belt onto the idler pulley. A torsion spring always urges the shift rod in a direction to place the agitator in drive so that removal of the engaging one of the cams from the rear leg of the shift rod places the motor driven belt on the intermediate drive pulley.

BRIEF DESCRIPTION OF THE DRAWINGS

Reference may now be had to the accompanying Drawings for a better understanding of the invention, both as to its organization and function with the illustration being of s preferred embodiment, but being only exemplary, and in which.

DETAILED DESCRIPTION OF THE INVENTION

Figure 1:
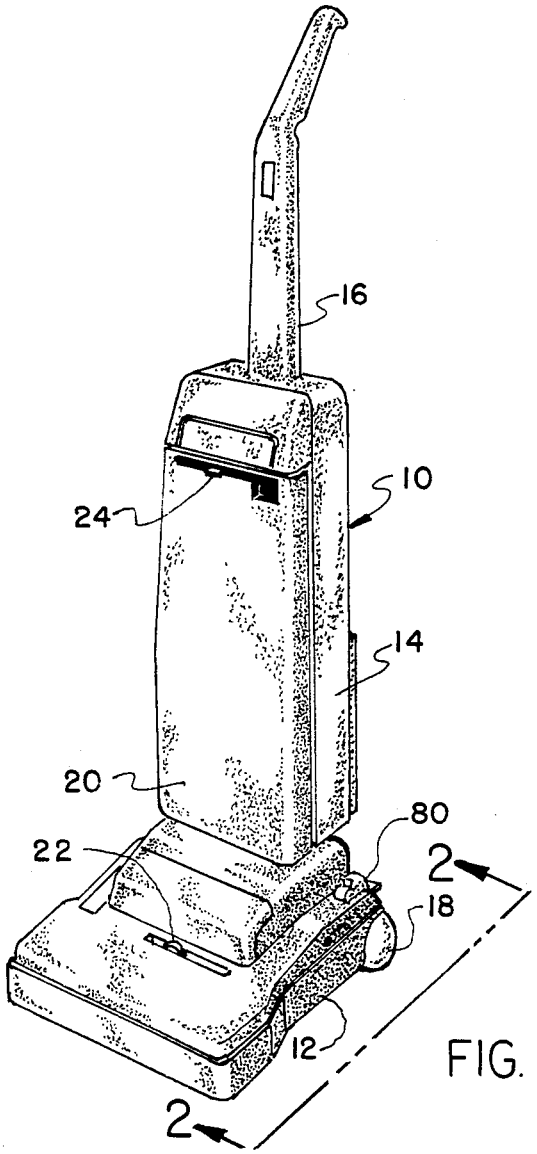
FIG. 1 is a perspective view of a cleaner that incorporates the invention.

There is shown in FIG. 1, an upright cleaner 10 having a hood 12 and a pivoted hard bag housing 14 containing the bag (not shown) utilized for dirt collecting purposes. The hard housing 14 is surmounted by a handle 16 utilized by the operator for manipulating the cleaner 10, while rear wheels 18, support the hood 12 and the cleaner 10. The hard housing 14 includes a removable front piece 20 to gain ingress to the dirt collecting bag. A lever 22 is provided in the hood 12 for height adjustment of front wheels (not shown) and a lever 24 in the front piece 20 initiates air flow through a scent dispenser or the like (not shown). As so far shown and described the cleaner 10 is generally conventional and forms only the environment for the inventive aspects of this Application.

Turning to the remaining Figures of the Drawings, it can be seen that a rotatable agitator 26 is driven by a belt 28 in its rotary motion, with the belt 28, in turn, trained on an agitator drive pulley 30 that is disposed intermediate the fore and aft direction of the hood 12 and mounted for rotation on a shaft 32. The shaft 32 is mounted fixed on a support 34 which may include a disk 36 within which the shaft 32 is telescopically fixedly inserted. The drive pulley 30 is fixed with or integral with an intermediate pulley 38, also rotating on shaft 32 and driven by a belt 40 that extends to a motor drive shaft 42 of a motor 44.

An idler pulley 46 is also disposed on the shaft 32, inboard of the intermediate pulley 38, with this pulley free to rotate on the shaft 32 independent of any connection with intermediate pulley 38 on the agitator drive pulley 30. The motor driven belt 40 may be disposed, alternately, on this idler pulley or the intermediate pulley 38. While on the idler pulley 46, there is no rotational drive transmitted to the agitator 26 since the idler pulley 46 freely rotates on the shaft 32 and the agitator drive pulley 30 is not rotating. Shifting of the belt 40 to the idler pulley 46 occasioned by a belt shifting rod 48 that extends forwardly and rearwardly in the cleaner 10 generally parallel to the trained belts 28, 40. This fork includes, at its forward end, a U-shaped bight portion 50 that extends over the top side of the belt 40 and engages it during its shifting movement. The belt shifting fork also includes a down turned leg 52 before the end of the fork having the bight portion 50 so that the bight portion opens downwardly instead of upwardly. This aids assembly.

The belt shifting fork 48 also includes a forward leg 54, terminating in the bight portion 50, and a rearwardly extending leg 56, spaced from each by a pivoting axle portion 58. The axle portion 58 is mounted with the hood 12 by means of forward and rearward blocks 60, 62 fast with the hood 12 and each forming half of a cylindrical bore 64, within which the axle portion 58 of belt shifting fork 48 pivots on an axis angulated relative to the vertical. A clearance 66, extending generally horizontally, and formed at the upper ends of the pivot blocks 60, 62 permits the forward leg 54 of the belt shifting fork 48 to swing through a horizontal swath as the axle portion 58 of the belt shifting fork 48 rotates in the cylindrical bore 64.

Figure 3:
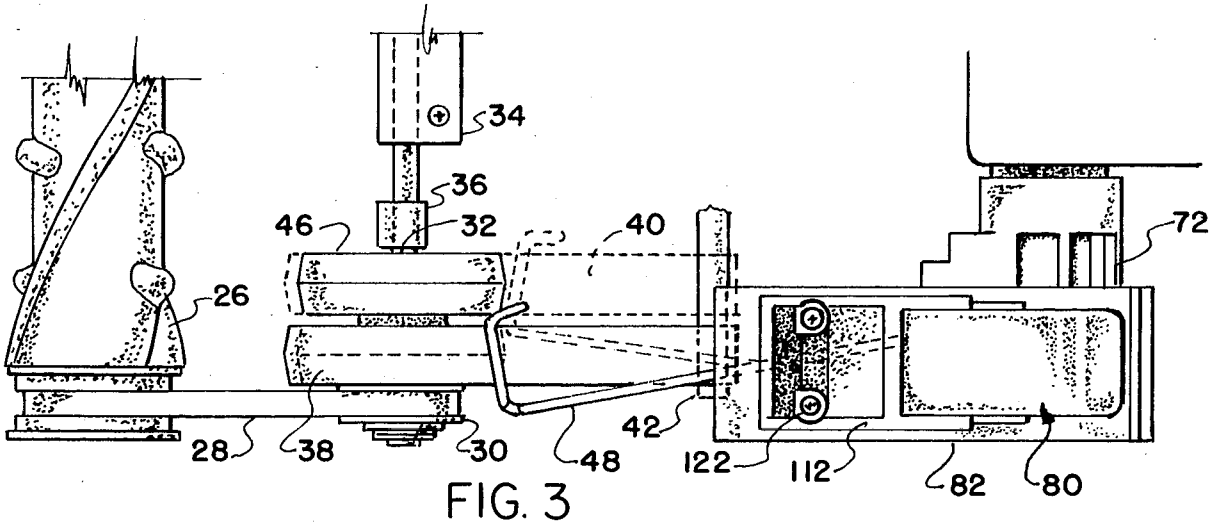
FIG. 3 is a partial plan view of the structure of FIG. 2 with some parts removed.
Figure 2:
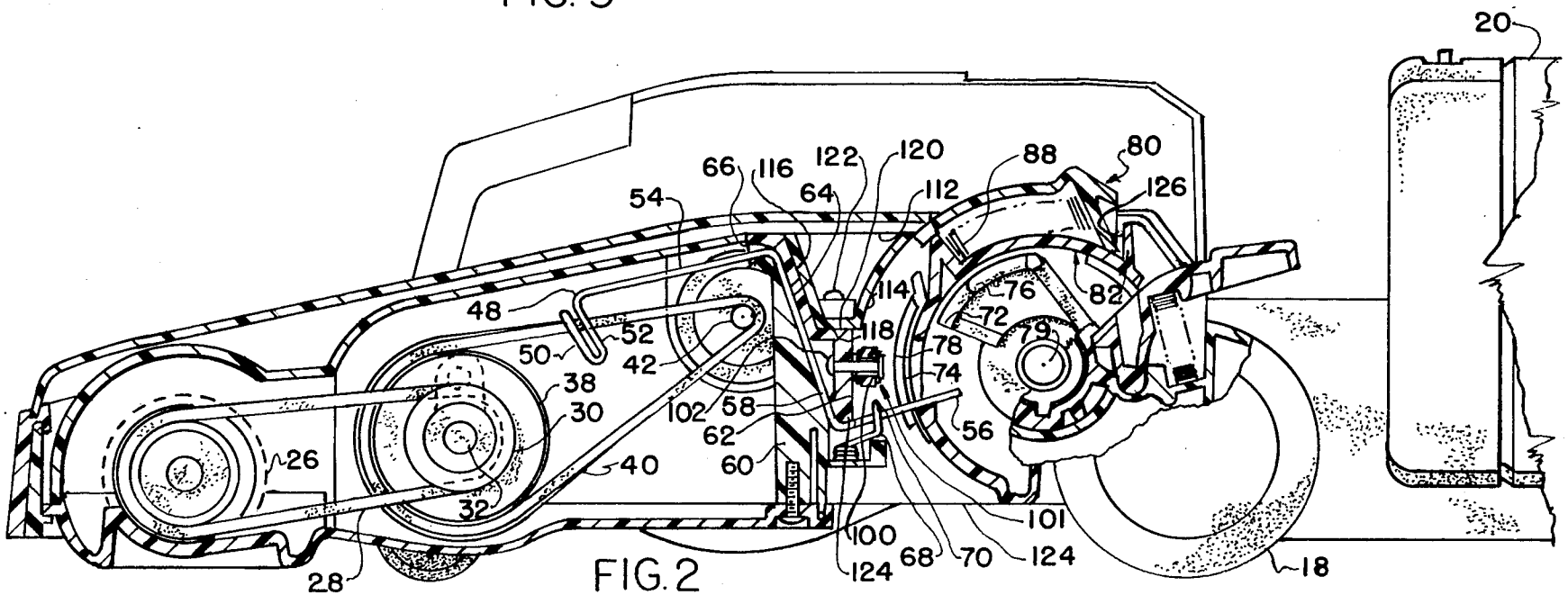
FIG. 2 is a cross sectional side elevational view of a cleaner foot incorporating the invention.

The belt shifting fork 48 is always urged to place the agitator 26 in drive relationship by a torsion spring 68 having an urging leg 70 that engages rearward leg 56 of belt shifting fork 48, tending to turn that leg inwardly relative to the width of the hood 12 which, in turn, tends to pivot the forward leg 54 of belt shifting lever 48 outwardly to move the belt 50 onto the intermediate pulley 38. Obviously the, cammed movement of rearward leg 56 in the opposite direction would tend to place the belt 50 on the idler pulley 46 to remove drive from the agitator 26. Such movement also places the belt 40 inwardly relative to the motor shaft 42 as shown partially in dashed lines in FIG. 3.

Camming of the belt shifting fork 48 is occasioned by two structures; a handle actuated cam 72 and a pedal actuated cam 74. Handle actuated cam 72 includes an outwardly angled face 76 that moves against the rearward leg 56 of belt shifting fork 48 to urge it pivotally outwardly relative to the width of the hood more and more as the handle actuated cam 72 pivots downwardly against it. This cam is mounted with the hard bag 20 and moves with it around a pivot 79 to place itself in an abutting, urging position relative to the rearward leg 56 or in a removed position relative to it. The handle pivot 79, itself, is detailed to a greater degree in Hoover, application Ser. No. 06/700,003 filed 8/25/86. Reference may now be had to that application for further amplification of it.

The pedal actuated cam 74 includes an angulated cam face 78, with the face angling outwardly relative to the hood 12 in the same manner as the cam face 76 of handle operated cam 72. Movement of the cam 74 is occasioned by foot pedal 80 disposed at the rear of the hood 12 and easily accessible for operator manipulation. Foot pedal 80 is moved forward to place the cam 74 in abuttingly engaged position.

Figure 6:
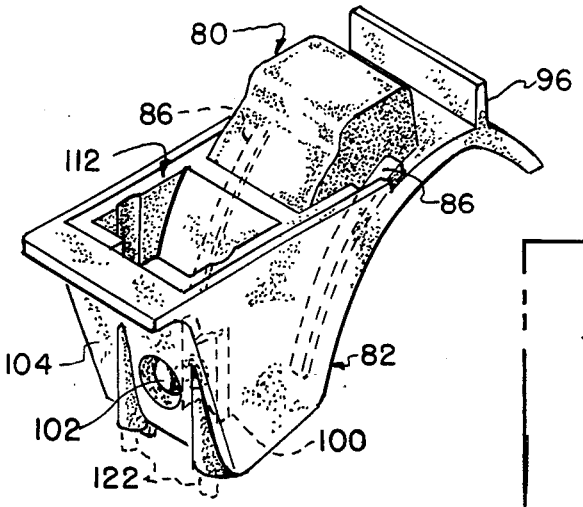
FIG. 6 is a perspective view of the structure of FIG. 5 in assembled condition.
Figure 5:
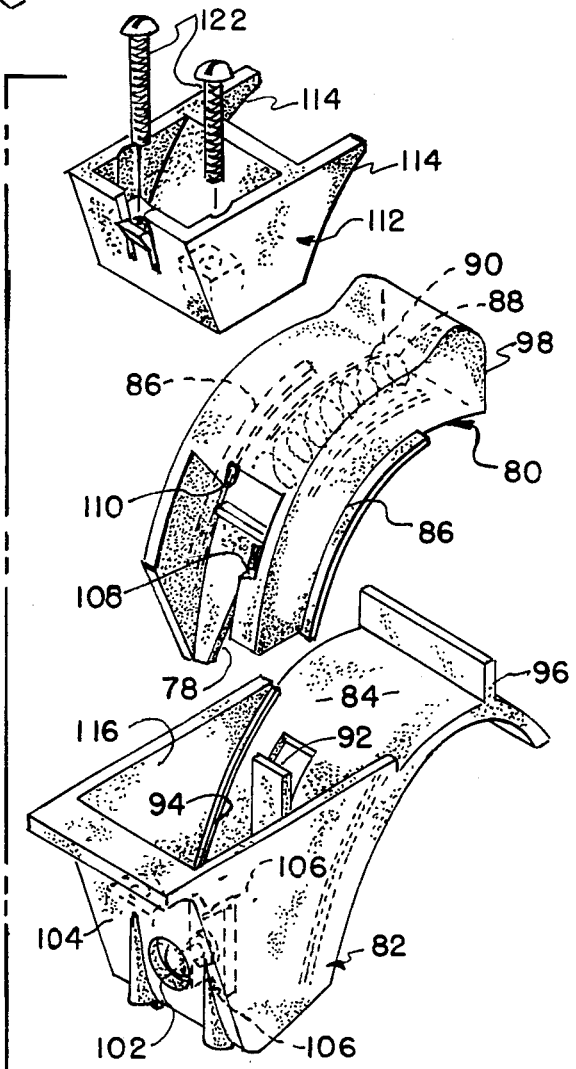
FIG. 5 is a partially exploded view of the foot pedal-cam structure.
Figure 4:
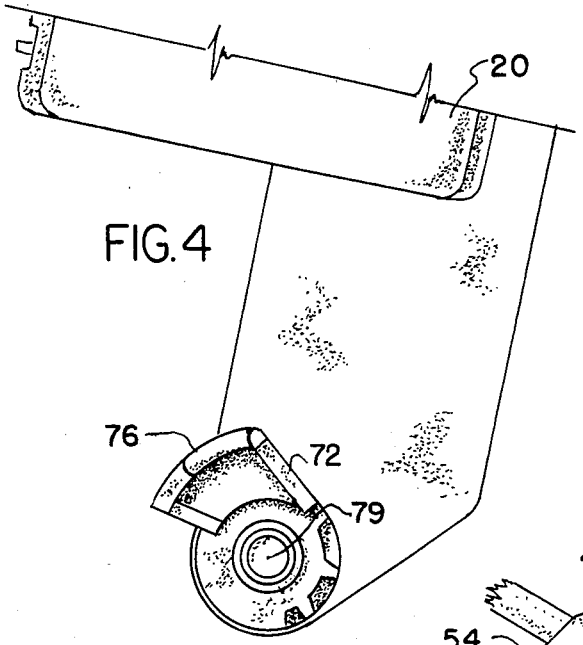
FIG. 4 is a perspective view of lower portion of the handle and its cam.
Figure 8:
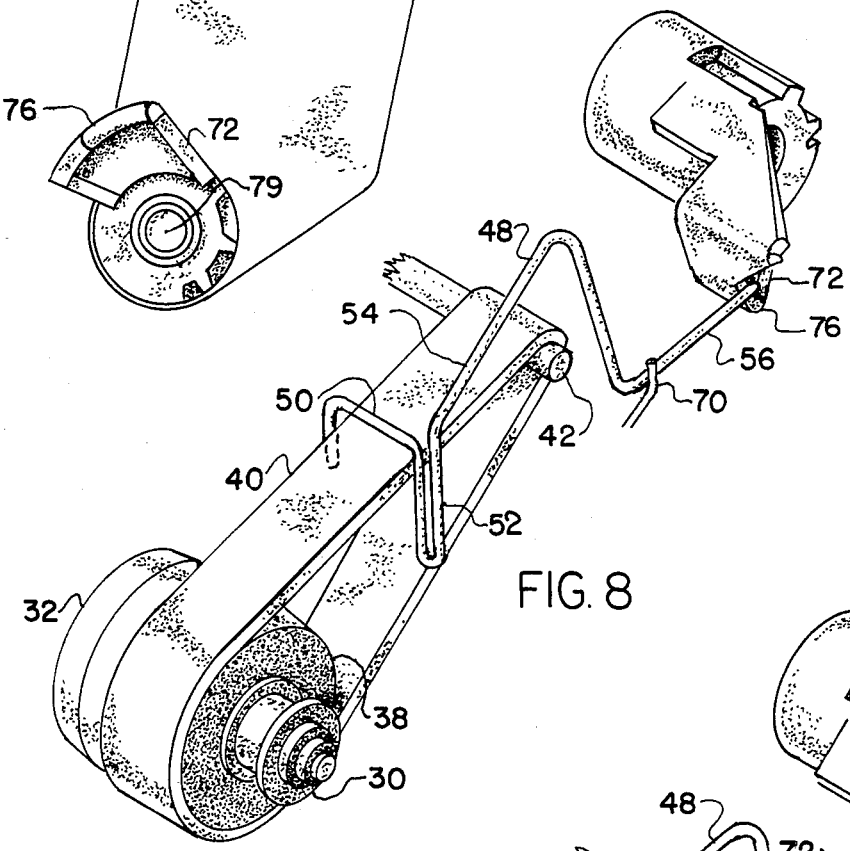
FIG. 8 is a fragmentary perspective view of the belt shifting rod in its position of engagement with the handle cam.
Figure 9:
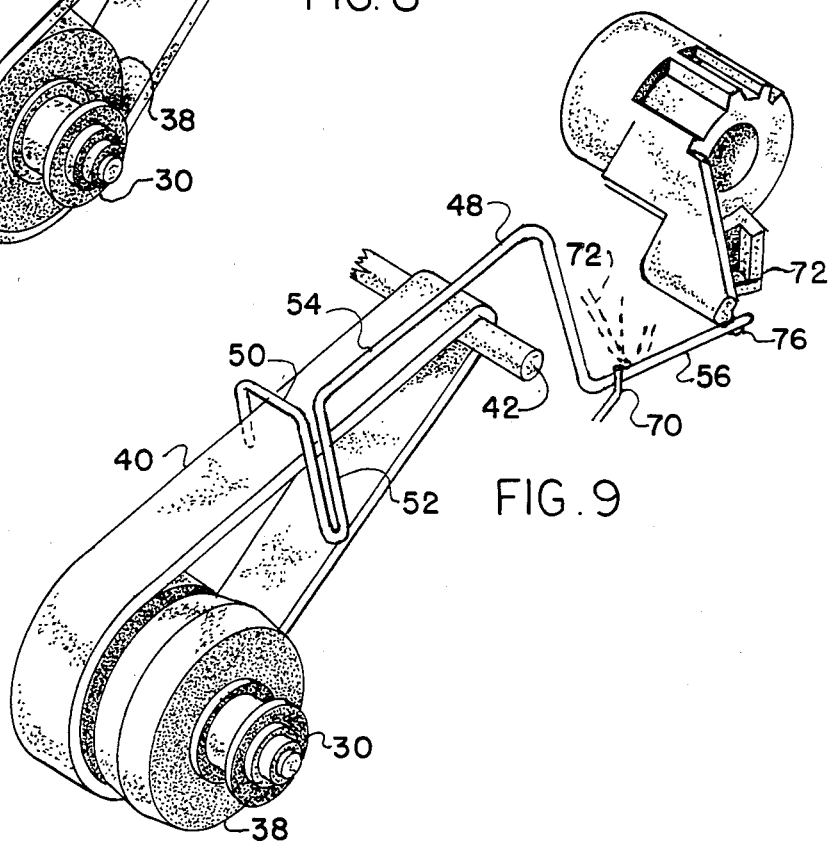
FIG. 9 is a fragmentary perspective view of the handle cam in disengaged position.
Figures 7, 10, 11:
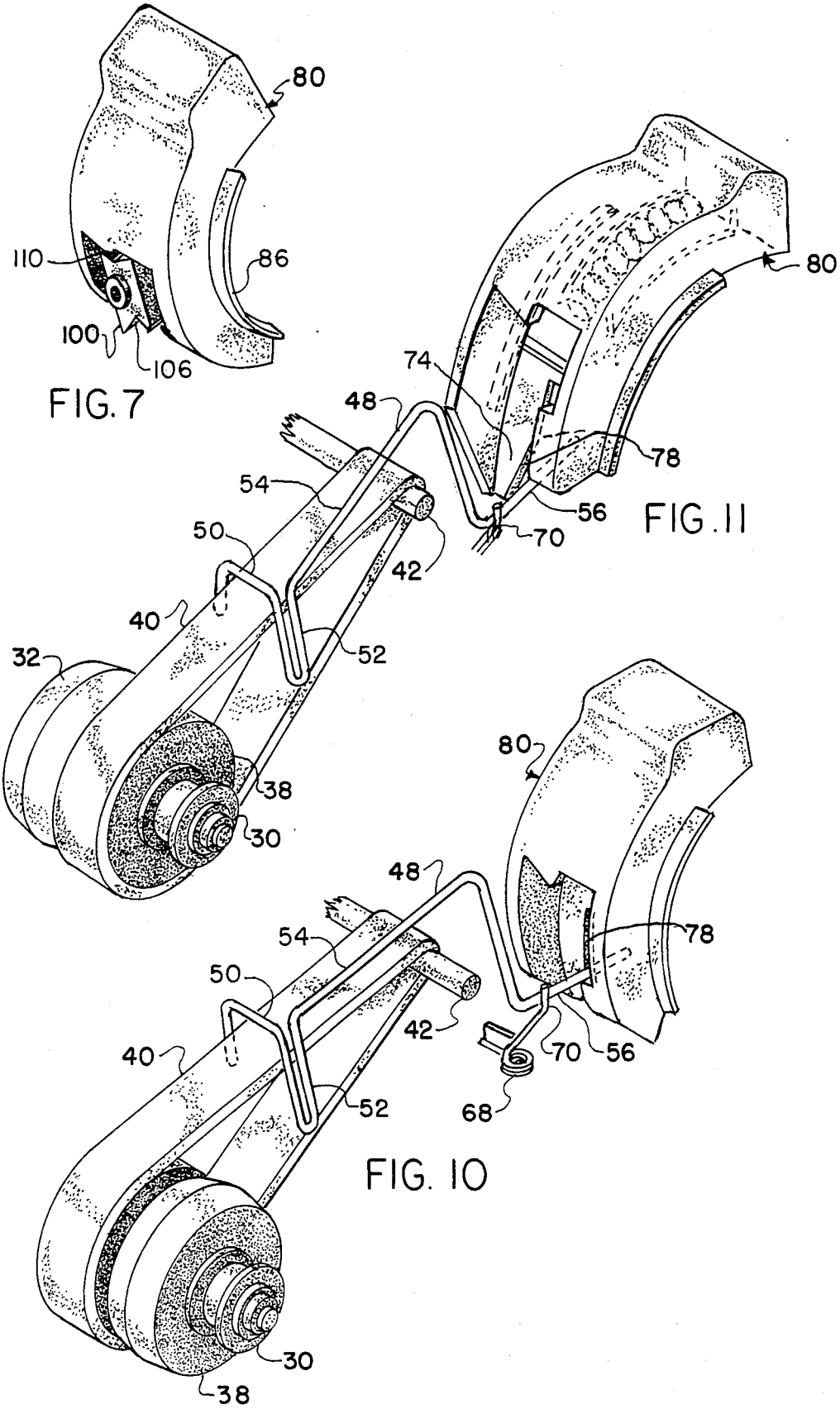
FIG. 7 is a fragmentary view of the push-push structure and actuating tab.
FIG. 10 is a fragmentary perspective view of the belt shifting rod in its position of engagement with the pedal cam.
FIG. 11 is a fragmentary perspective view of the pedal in disengaged position.

A more detailed illustration of the foot pedal 80 and surrounding structure can be seen in FIGS. 4 and 5. A pedal housing 82 includes an arched ramp 84 along which pedal 80 moves by means of arched track surfaces 86, 86 to slide forwardly or rearwardly in an arcuate manner to place the cam 74 into or out of engagement with belt shifting fork 48. A coiled compression spring 88, seating in a spring seat 90 on the undersurface of pedal 80, extends forwardly within the pedal 80 to have its other end engage against a spring stop 92 on pedal housing 82. Thus, pedal 80 is always resiliently urged rearwardly through the aegis of spring 88.

Pedal housing 82 includes ways 94, 94 that extend arcuately along the inner and outer edges of arched ramp 82 to insure aligned movement of foot pedal 80 during its arcuate reciprocation within pedal housing 82. A stop 96 on pedal housing 82 serves as a location for a rearward limit for pedal 80, a back surface 98 on it engaging with stop 96 at its rearward most point of travel. The pedal housing 82 also carries at its front end a pawl 100 pivoted on a horizontal axis formed by a pin 102 extending through a front wall 104 of pedal housing 82. The pawl 100 serves as a part of a push-push mechanism 101 to govern the reciprocatory arcuate movement of foot pedal 80 as it is manually actuated by an operator.

Pawl 100 includes on its opposite ends a pair of "V" notches 106, 106 which act as an engagement means for a tab 108 on foot pedal 80 while a tab 110 on foot pedal 80 serves as a cam to move the pawl 100 (one of notches 106, 106) to a non-engaging position with tab 108 to permit the foot pedal 80 to again assume its rearward resiliently urged position. Movement of foot pedal 80 from its free, rearward position, is forwardly at which time the camming tab 110 engages the uppermost "V" notch 106 to turn the pawl 104 in a counterclockwise direction when viewed from the front. This places the pawl 104 in a slightly angulated position relative to the vertical so that the tab 108 locks against the edge of the opposite "V" notch 106. A second forward movement of the foot pedal 80 causes the camming tab 110 to again urge the pawl 104 counterclockwise so that rearward movement of pedal 80, by urging spring 88, is not opposed by the pawl 104, the tab 108 clearing the pawl 104 during its rearward movement.

Although the push-push mechanism 101 has not been illustrated in its various positions in this application, it is an old, known structure in the patent art, U.S. Pat. No. 3,873,790 showing this push-push mechanism clearly. In that patent, tabs 204 (cam) and 224 (latch) are the equivalent to tabs 110 and 108, respectively, in this application. Thus, no further description of the push-push mechanism 101 is here given. Suffice it to say that any push-push mechanism which would fit within the confines of the pedal arrangement would operate to provide the needed function.

The foot pedal housing 82, with the foot pedal 80 and spring 88 assembled is held in the cleaner 10 by means of a housing cap 112 having partly arcuate walls 114, 114 that engage over arched track surfaces 86, 86 on foot pedal 80. These walls then limit movement of the arched track surfaces 86, 86 vertically. The housing cap 112 sits within a forward portion 116 of foot pedal housing 82 with a flat 118 on the housing cap 112 abutting a flat 120 on the pedal housing 82. Screws 122, 122, at this location, extend from the housing cap 112 through the pedal housing 82 and attach to rearward pivot block 62 of a frame 124 for the hood 12 of the cleaner 10. A lip 126 of the frame 124 holds the pedal housing at its rear by being inserted in front of stop 96.

The operation of the belt shifting arrangement of the invention now may be apparent. Assuming that the belt 40 is on the intermediate pulley 38 and the agitator 26 is being driven by a motor shaft 42, a state of equilibrium has been reached because the torsion spring 68 tends to maintain this position of the driving elements. In order to disengage drive of the belt 40, by shifting this belt to the idler pulley 46, either the handle 16 or the foot pedal 80 must be moved. If the handle 16 is chosen, it is pivoted to its uppermost position moving the handle actuated cam 72, through its cam face 76, against the rearward leg 56 of belt shifting rod 48. This urges it outwardly so that the opposite leg of belt shifting rod 48, through its bight portion 50, moves the motor belt 40 to the idler pulley 46. The agitator 26, is then no longer being driven.

If the pedal actuated cam 74 is actuated to place the agitator 26 in a non-drive position, it is urged forwardly in a partly arcuate manner, by an operator, and the pedal actuated cam 74, through its cam face 78, engages the rear leg 56 of belt shifting rod 48 to urge it outwardly. Again, this shifts the belt 40 and the idler pulley 46 removing drive from the agitator 26. Since the foot pedal 80 is spring urged rearwardly by compression spring 88 it would return to its non-camming position except for the push-push mechanism 101 that arrests this movement of pedal 10. In order to remove cam face 78 from its engagement with rearward leg 56 of belt shifting rod 48 to permit the agitator 26 to be driven again through the motor shaft 42, through the urging of torsion spring 68, the pedal 80 is again moved forwardly to release it. Push-push mechanism 101 then permits the foot pedal 80 to be moved rearwardly by compression spring 88 to pivotally place pedal operated cam 74 in an inactive position.

It should be noted that actuation of agitator drive release by either of the cams 72, 74 and then actuation of the other cam will have no effect on the belt shifting arrangement other than to put this other cam in a then inactive shift position. It should also be noted that the cams 72, 74 do not interfere with one another during their movement since they are, generally concentric with the pivot 79.

It should be clear from the foregoing, that a belt shifting arrangement has been disclosed which fully meets the advantages set out for it at the beginning portion of the description. It should also now be obvious that many modifications could obviously be made to the disclosed structure which would still fall within the spirit and purview of the description offered.

What is claimed is:

1. In an upright vacuum cleaner having a handle and an operator contactable means, the combination including;
   (a) a belt for driving an agitator of said upright cleaner,
   (b) a drive pulley and an idler pulley,
   (c) a shifting mechanism for engaging said belt and moving it from said drive pulley to said idler pulley,
   (d) a first means for engaging said shifting mechanism, actuated by said handle, for moving said shifting mechanism to place said belt on said idler pulley, and
   (e) a second means for engaging said shifting mechanism, actuated by said operator contactable means, for moving said shifting mechanism to place said belt on said idler pulley.

2. An upright vacuum cleaner as set out in claim 1 wherein;
   (a) said first and second means for engaging engage said shifting mechanism at spaced locations on it.

3. An upright vacuum cleaner as set out in claim 1 wherein;
   (a) said operator contactable means comprises a pedal located at rear portions of said cleaner.

4. An upright vacuum cleaner as set out in claim 3 wherein;
   (a) said pedal includes a push-push mechanism for always returning said pedal to its disengaged position.

5. An upright vacuum cleaner as set out in claim 4 wherein;
   (a) said push-push mechanism includes a pivoting pawl and a means for camming said pawl.

6. An upright vacuum cleaner as set out in claim 1 wherein;
   (a) a belt shifting rod is pivotally mounted with said vacuum cleaner,
   (b) said belt shifting rod includes a portion extending in a front to rear direction in said vacuum cleaner,
   (c) said first and second means for engaging said shifting mechanism moveable to forcedly abut said portion for pivoting movement of said shifting rod to thereby place said belt on said idler pulley.

7. An upright vacuum cleaner as set out in claim 6 wherein;
   (a) said first and second means for alternating engaging said shifting mechanism including separate cams moveable into said forced abutment.

8. A vacuum cleaner having a belt shifting arrangement including;
   (a) an operator manipulated lever extending outwardly from and terminating closely adjacent a hood of said cleaner,
   (b) said lever being capable of operator manipulation in a fore and aft direction of said hood,
   (c) said lever means being attached to a means for camming said belt to provide said belt shifting,
   (d) said lever forming a pedal,
   (e) said pedal seated on an arcuate ramp for arcuate movement relative to said vacuum cleaner,
   (f) said arcuate ramp formed in a housing for said pedal, and
   (g) a cover having an arcuate ramp disposed above said housing.

9. The vacuum cleaner having the belt shifting arrangement of claim 8 wherein;
   (a) said pedal includes arcuate tracks captured between said housing and said cover.

10. The vacuum cleaner having the belt shifting arrangement of claim 9 wherein;
   (a) said means for camming includes a cam formed on said pedal.

11. The vacuum cleaner having the belt shifting arrangement of claim 10 wherein;
   (a) said pedal is resiliently urged rearwardly, and
   (b) a push-push mechanism in at least one position opposes said resilient urging.

* * * * *